US007515688B2

(12) United States Patent
Harding

(10) Patent No.: US 7,515,688 B2
(45) Date of Patent: Apr. 7, 2009

(54) ANODE MODULE FOR A LIQUID METAL ANODE X-RAY SOURCE, AND X-RAY EMITTER COMPRISING AN ANODE MODULE

(75) Inventor: Geoffrey Harding, Hamburg (DE)

(73) Assignee: GE Homeland Protection, Inc., Newark, CA (US)

( * ) Notice: Subject to any disclaimer, the term of this patent is extended or adjusted under 35 U.S.C. 154(b) by 0 days.

(21) Appl. No.: 10/599,420

(22) PCT Filed: Mar. 30, 2005

(86) PCT No.: PCT/EP2005/003334

§ 371 (c)(1),
(2), (4) Date: Nov. 6, 2006

(87) PCT Pub. No.: WO2005/096341

PCT Pub. Date: Oct. 13, 2005

(65) Prior Publication Data

US 2007/0258563 A1 Nov. 8, 2007

(30) Foreign Application Priority Data

Mar. 30, 2004 (DE) ..... 10 2004 015 590

(51) Int. Cl.
*H01J 35/08* (2006.01)
*H01J 35/18* (2006.01)

(52) U.S. Cl. ..... 378/143; 378/121; 378/161

(58) Field of Classification Search ..... 378/121, 378/143, 161
See application file for complete search history.

(56) References Cited

U.S. PATENT DOCUMENTS 2,665,390 A * 1/1954 Zunick et al. ..... 378/141

(Continued)

FOREIGN PATENT DOCUMENTS

DE 19900467 A1 4/2000

(Continued)

OTHER PUBLICATIONS

David et al.: "Liquid metal anode x-ray tube", Proceedings of SPIE vol. 5196, Jan. 2004, pp. 432-443, XP002336484, Bellingham, WA, 2004.

(Continued)

*Primary Examiner*—Edward J Glick
*Assistant Examiner*—Thomas R Artman
(74) *Attorney, Agent, or Firm*—GE Global Patent Operation

(57) ABSTRACT

The invention relates to an anode module 1 for a liquid-metal anode X-ray source which has an electron entry window 3 in the region of focus 2.

It is provided according to the invention that an X-ray beam exit window 4 lies opposite the electron entry window 3 of the anode module 1 and the exit angle Θ of the X-ray beams 7 between an electron beam 6 entering through the electron entry window 3 along the direction of incidence 5 and the X-ray beams 7 exiting through the X-ray beam exit window 4 is between 5° and 50°, in particular 15°.

The invention also relates to an X-radiator with an electron source for the emission of electrons and a liquid-metal anode emitting X-ray beams 7 when the electrons strike, which has an anode module 1 with the above-named features.

15 Claims, 3 Drawing Sheets

U.S. PATENT DOCUMENTS

| | | | | |
|---|---|---|---|---|
| 5,052,034 | A * | 9/1991 | Schuster | 378/121 |
| 5,105,456 | A | 4/1992 | Rand et al. | |
| 6,185,277 | B1 * | 2/2001 | Harding | 378/143 |
| 6,477,234 | B2 * | 11/2002 | Harding et al. | 378/141 |
| 6,560,313 | B1 * | 5/2003 | Harding et al. | 378/143 |
| 6,647,094 | B2 * | 11/2003 | Harding et al. | 378/143 |
| 6,735,283 | B2 * | 5/2004 | Kutschera et al. | 378/144 |
| 6,807,248 | B2 * | 10/2004 | Mihara et al. | 378/10 |
| 6,961,408 | B2 | 11/2005 | Harding et al. | |
| 2002/0048344 | A1 * | 4/2002 | Bachmann et al. | 378/121 |
| 2002/0048345 | A1 * | 4/2002 | Bachmann et al. | 378/121 |
| 2003/0058995 | A1 | 3/2003 | Kutschera et al. | |
| 2005/0175153 | A1 | 8/2005 | Harding et al. | |

FOREIGN PATENT DOCUMENTS

| | | | |
|---|---|---|---|
| EP | 0584871 | B | 11/1996 |
| EP | 0676772 | A1 | 5/1998 |
| FR | 741148 | A | 2/1933 |
| WO | WO 03/077277 | A | 9/2003 |

OTHER PUBLICATIONS

Li Ping-Wei et al.: Applications of Polycapillary X-Ray optics in Protein Crystallography:, Journal of Applied Crystallography,vol. 31, Oct. 1998, pp. 806-811, XP009051447, Denmark.

* cited by examiner

ANODE MODULE FOR A LIQUID METAL ANODE X-RAY SOURCE, AND X-RAY EMITTER COMPRISING AN ANODE MODULE

BACKGROUND OF THE INVENTION

The invention relates to an anode module for a liquid-metal anode X-ray source which has an electron entry window in the region of focus. The invention also relates to an X-radiator with such an anode module.

It has been known since recently to use liquid-metal anodes to produce X-ray beams. This technique is called LIMAX (Liquid-metal anode X-ray). When producing X-ray beams the liquid-metal anode is bombarded with an electron beam. As a result the liquid-metal anode heats up considerably—like any solid anode. The heat that forms must be removed from the region of focus in order that the anode does not overheat. This takes place in liquid-metal anodes by means of turbulent mass transport, convection, conduction and electron diffusion processes. In the region of focus in which the electrons strike the liquid-metal anode, the line system of the liquid-metal anode has an electron window. This consists of a thin metal foil which is so thin that in it the electrons lose only a small part of their kinetic energy. The yield of X-radiation at 90° to the incident electron beam is, however, not very high.

BRIEF DESCRIPTION OF THE INVENTION

Therefore the object of the invention is to provide an anode module for a liquid-metal anode X-ray source and an X-radiator in which a higher yield of X-radiation is achieved.

The object is achieved by an anode module for a liquid-metal anode X-ray source with the features of claim 1. Because the X-radiation produced by the interaction of the electrons striking the liquid-metal anode with same is not isotropic, but aligned in the direction of flow of the electrons, it is advantageous to use the X-radiation produced in forward direction of the electron beam from the liquid-metal anode. The angle relative to the incident electron beam at which a maximum of X-radiation is emitted depends in particular on the energy of the incident electrons. The more relativistic the electrons—i.e. the ratio between electron energy $E_0$ and rest mass of the electron of 511 keV approaches 1—the more significant does this anisotropy become. According to the invention the yield of X-radiation is increased because the X-ray beam exit window is not arranged at 90° to the incident electron beam but at a small angle—the exit angle of the X-radiation—thus in forward direction. The optimum angle depends greatly on the electron energy, being 15° at an electron energy $E_0$=500 keV.

An advantageous development of the invention provides that the electron exit window is a metal foil, in particular of tungsten, 5 to 30 μm, in particular 15 μm, thick. With such a thickness there is only a very small loss of electron energy in the electron entry window. With a thickness of 15 μm this is only 5% of the electron energy. However, in respect of the thickness of the electron entry window a compromise must be accepted due to its mechanical stability. Too thin an electron entry window would no longer satisfy the mechanical conditions inside the anode module, in particular the liquid pressure and the shearing forces occurring, and become unstable or even burst. To meet the above-named requirements, the electron entry window can also be formed as a diamond film, a ceramic material or a monocrystal, in particular of cubic boron nitride.

A further advantageous development of the invention provides that the X-ray beam exit window is a steel sheet 100 to 400 μm, in particular 250 μm, thick. Because there is an interaction with the exiting X-ray beams in the X-ray beam exit window, this must not be too thick. The optimum thickness depends on what degree of attenuation is acceptable and what average energy of the X-radiation is to be retained. The mechanical stability of the X-ray beam exit window also sets a lower limit for its thickness.

A further advantageous development of the invention provides that in the region of focus the anode module is 100 to 350 μm, in particular 200 μm, thick in the direction of the incident electron beam. Due to the penetration depth of the electrons into the liquid-metal anode it is possible to vary the thickness of the anode module in the region of focus within a certain range. This range is severely limited by the fact that the produced X-ray beams must still pass across the whole of the liquid metal (this path is longer or shorter depending on the angle at which the X-ray beam exit window is arranged). Too great a thickness is not possible, because the X-ray beam yield would be disproportionately reduced by self-absorption in the liquid metal.

A further advantageous development of the invention provides that in the region of focus the anode module has a constricting channel in the direction of the incident electron beam and outside the region of focus is 5 to 10 mm, preferably 8 mm, thick. It is thereby possible that the above-stated very small dimensions must be observed only in the anode module, around the region of focus, and the whole of the rest of the line can have a considerably larger cross-section. Thus cheaper pumps can be used to circulate the liquid metal and the liquid-metal anode thereby becomes significantly more economical.

A further advantageous development of the invention provides that the region of focus runs parallel to the Y-Z plane which stands perpendicular to the direction of flow of the liquid metal. Thus, for example in the case of an electron entry window formed with a cylinder surface shape, it is ensured that the region of focus runs substantially in a straight line and thus there are no paths of different lengths through the liquid-metal anode. On the basis of the given definition of the Y-Z plane the X-axis travels along the direction of flow of the liquid metal. The Y-axis is aligned parallel to the axis of the cylindrical electron entry window and the Z-axis along a radius of the cylindrical electron entry window.

A further advantageous development of the invention provides that the angle of incidence between the direction of incidence of the electron beam and the Z-axis is between 5° and 65°, preferably 50°. The effect of this is that the region of focus becomes larger for the same electron beam dimensions, because the projected surface area is larger. The actual region of focus which corresponds to the surface area struck by the electrons is thus increased. As a result the heat that has formed is better removed and thus higher capacities can be beamed in.

A further advantageous development of the invention provides that the angle of incidence, the anode angle and the exit angle all lie in the Y-Z plane. An outstanding yield in respect of the produced X-ray beams in relation to the incident electrons is thereby achieved.

The object is also achieved by an X-radiator with an electron source for the emission of electrons and a liquid-metal anode emitting X-ray beams when the electrons strike which has an anode module according to one of the designs described above.

BRIEF DESCRIPTION OF THE DRAWINGS

Further details and advantages of the invention are described in more detail with reference to the embodiment represented in the Figures. There are shown in.

DETAILED DESCRIPTION OF THE INVENTION

Figure 4:
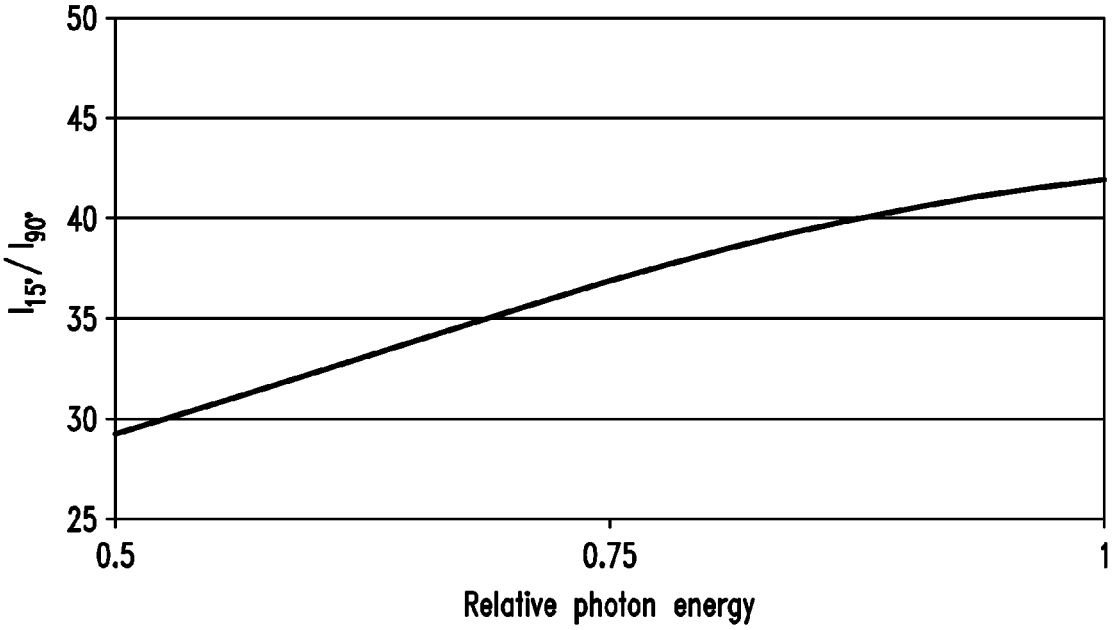

As already stated above, the angular distribution of the produced X-radiation is not isotropic, but aligned in the direction of the direction of incidence 5 of the electron beam 6. The more highly energetic the electrons become, the more pronounced is this anisotropy. At an electron energy of $E_0$=500 keV the maximum X-radiation is emitted at an angle of approximately 15° to the direction of incidence 5 of the electron beam 6. In FIG. 4 the relationship of the X-ray beam yield at 15° to the direction of incidence 5 of the electron beam 6 to the X-ray beam yield at 90° to the direction of flow of the electrons 5 of the electron beam 6 in relation to the relative photon energy is represented. It is clear that it is by a factor of approximately 35 that the emission of X-radiation at an exit angle Θ of 15° is higher than that at 90°. The more closely the "peak region" of the spectrum is approached in which the photon energy is approximately the same size as the electron energy, the higher the factor becomes.

Figure 1:
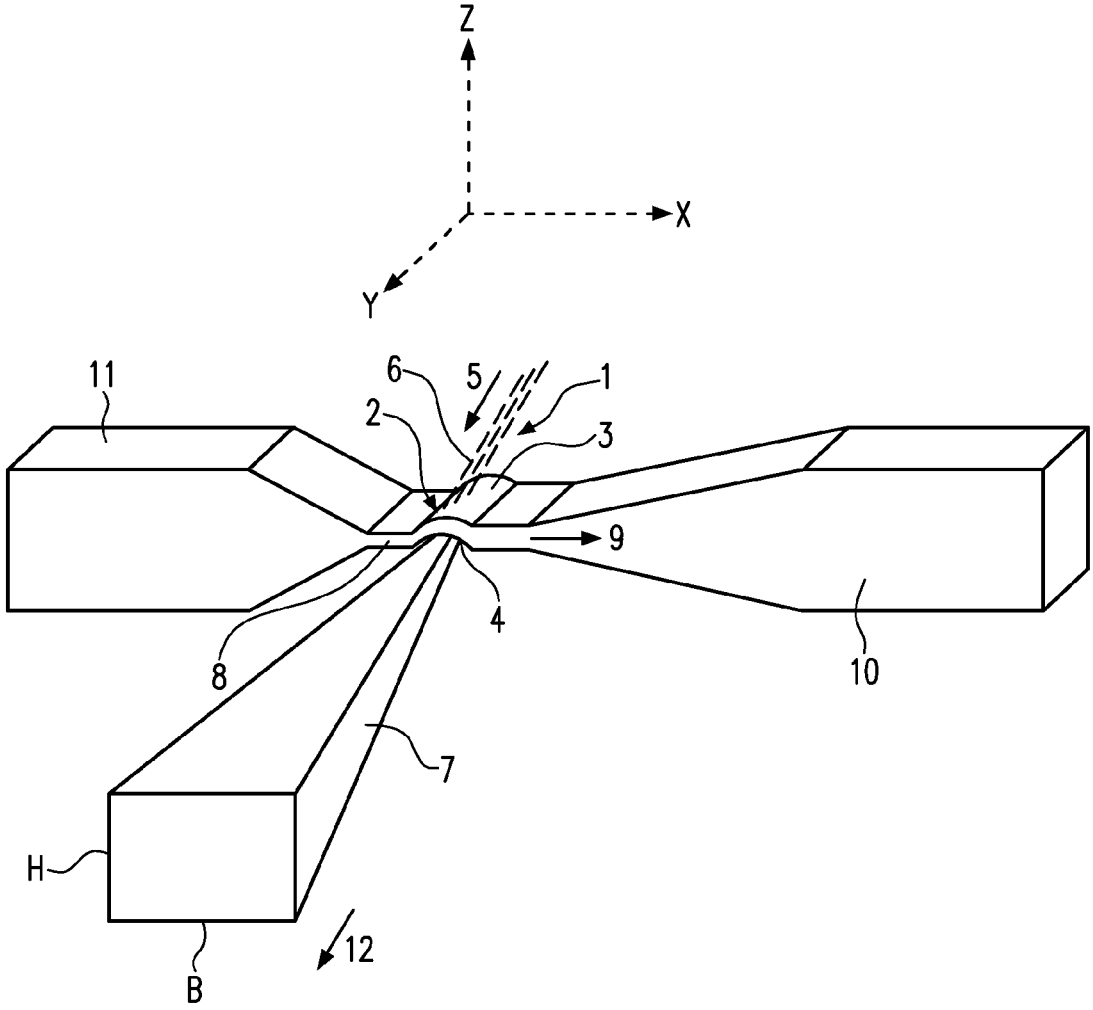
FIG. 1A perspective view of a schematically represented section cut from a line according to the invention around the region of focus, FIG. 2A cross-section through the anode module of FIG. 1 along the X-Z plane, FIG. 3A section cut from an electron entry window of the anode module from FIGS. 1 and 2 with the angles of interest and FIG. 4A diagram of the forward-directed emission of X-radiation.
Figure 2:
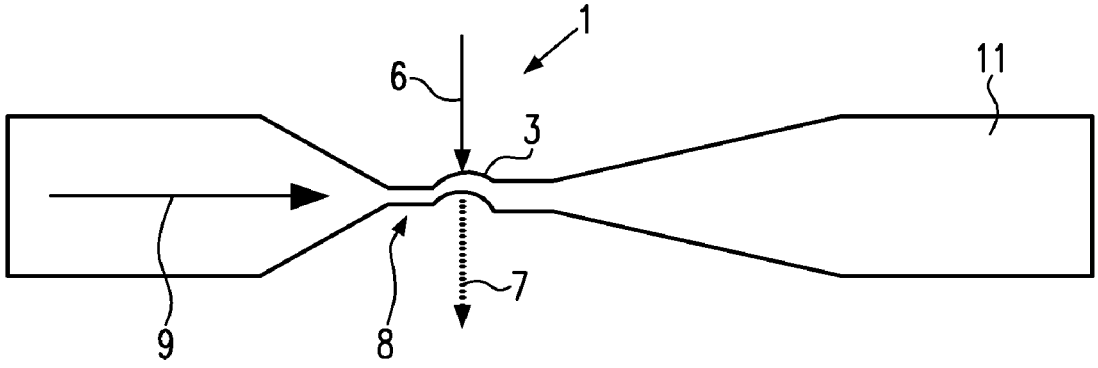

On the basis of this relationship an embodiment according to the invention for an anode module 1 for a liquid-metal anode X-ray source is represented in FIGS. 1 and 2 in which there are formed in the region of focus 2 an electron entry window 3 and opposite this an X-ray beam exit window 4. This X-ray beam exit window 4 is arranged vis-à-vis the direction of incidence 5 of the electron beam 6 at the above-stated exit angle Θ of the X-ray beams 7 of 15°. It is to be seen in the cross-section of FIG. 2 that both the incident electron beam 6 and the exiting X-ray beam 7 travel in the Y-Z plane. However, here only the central beam is represented as X-ray beam 7. On the other hand, it is very clear from FIG. 1 that this is a divergent X-ray beam 7, one which however has, not a circular cross-section, but a different width B and height H. In the representation the cross-section is represented as rectangular. This serves merely for simplified viewing. In reality the cross-section is more probably elliptical, due to the physical and mathematical conditions during the production of the X-ray beams 7 in the anode module 1. The width B lies approximately in an angle range of ±20° around the central beam of the X-ray beams 7. On the other hand, the height H lies merely in an angle range of approx. ±5° around the central beam. A relationship of approx. 4 thus results between the width B and the height H. However, this relationship again depends greatly on what energy the incident electron beam 6 has, which materials are used for the electron entry window 3, the X-ray beam exit window 4, and what liquid metal 10 is used. Moreover, the angle of incidence α at which the electron beam 6 falls onto the electron entry window 3 also plays an important role.

The anode module 1 must in particular meet some geometric requirements in the region of focus 2 in order that as intensive as possible an X-ray beam 7 exits through the X-ray beam exit window 4. These geometric conditions depend greatly on the materials used—for example for the electron entry window 3, the X-ray beam exit window 4, the liquid metal used—and on the energy of the electron beam 6.

The thickness of the electron entry window 3 can be deduced from the Thomson-Whiddington equation. This reads $$x = \frac{(E_0^2 - E^2)}{b\rho}$$

$E_0$ is the electron energy and x the intended reach which is necessary to reduce the average electron energy to the energy E. ρ is the value of the thickness of the material used for the electron entry window 3. b designates the Thomson-Whiddington constant, which has a value of $8.5\times10^4$ $keV^2$ $m^2$ $kg^{-1}$ for the tungsten electron entry window 3 used in the present case. From this, a value of 0.27 kg $m^{-2}$ results for ρ x. If only 5% of the electron energy in the electron entry window 3 is to be lost, a thickness of 15 μm results for this.

The X-ray beam exit window 4 is arranged in the region of focus 2 at the surface of the anode module 1 opposite the electron entry window 3. In the present case a maximum attenuation of 10% of the X-radiation produced in the liquid-metal anode at an average energy of 250 keV has been preset as key data. A thickness of 250 μm thus results for an X-ray beam exit window 4 made of steel.

In the region of focus 2 the line 11 is markedly constricted vis-à-vis the rest of the line 11 following the shape of the anode module 1, so that a constricting channel 8 is formed. This constricting channel 8 must strike a compromise between two competing factors. On the one hand there must be a long path length of the electrons in the liquid metal 10 in order that a maximum conversion of the electron energy into X-radiation can take place. This corresponds to a large channel height parallel to the direction of incidence 5 of the electron beam 6 and perpendicular to the direction of flow 9 of the liquid metal 10. On the other hand the channel height must be as small as possible in order that the produced X-ray beams 7 are not disproportionately attenuated by self-absorption in the liquid metal 10. If the Thomson-Whiddington equation is applied to the liquid metal 10 (BiPbInSn) used, a loss of 33% of the electron energy is obtained for a channel height of approx. 200 μm. Because a greater channel height only leads to the production of relatively low-energy X-ray beams 7 and simultaneously the self-absorption of the X-ray beams 7 in the liquid metal 10 increases, the above-named value for the channel height is a good compromise between the two above-named requirements.

The electron diffusion over a depth of 200 μm is by far the most important process which leads to the thermal transport of the heat that formed in the region of focus 2 due to the interaction between the electron beam 6 and the liquid metal 10. At a flow rate of 25 m $s^{-1}$ of the liquid metal 10, the product of the channel height (200 μm), the focus length (here 5 mm) and the flow rate (25 m $s^{-1}$) results in the volume of the liquid metal 10 per second in which the electron beam 6 gives off its energy. A material flow of $2.5\times10^{-5}$ $m^3$ $s^{-1}$ is thereby obtained. Using BiPbInSn as liquid metal 10, on the basis of the heat capacity ($c_p$=0.263 kJ $kg^{-1}$ $K^{-1}$ at 65° C.) and a density of $\rho=8.22\times10^3$ kg $m^{-3}$ at 65° C., the liquid-metal anode X-ray tube has a direct current power consumption of over 25 kW if a maximum temperature increase of 500°K is permitted. An effective focus size of 1 mm×1.3 mm then results.

Figure 3:
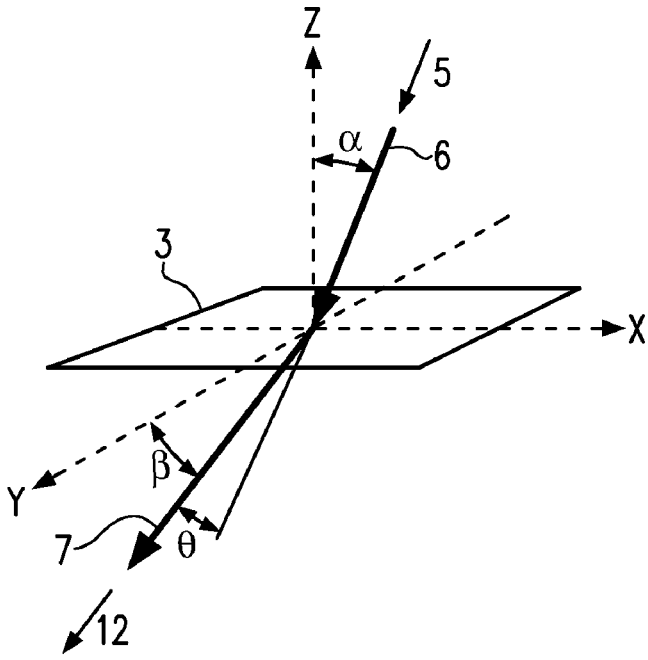

In FIG. 3 the individual occurring angles are represented. A section cut from the electron entry window 3 is shown. The direction of flow 9 of the liquid metal 10 travels along the X-axis. The electron beam 6 falling along the direction of incidence 5 lies in the Y-Z plane. It is inclined by the angle of incidence a to the Z-axis. The X-ray beam 7 exiting from the anode module 1 along the exit direction 12 also travels in the Y-Z plane. However, it is not parallel to the angle of incidence α, but inclined by the exit angle θ towards the Y-axis. The anode angle β is formed between the Y-axis and the X-ray beam 7. If the value already stated above for the exit angle θ of the X-radiation 7 of 15° is considered and an anode angle β of 25° is assumed, then simple geometric deliberations are used to show that the angle of incidence α of the electron beam 6 must have a value of 50°. If it is desired to consider the produced X-ray beam 7 at another anode angle β, then, with the exit angle θ kept constant, the corresponding angle of incidence α that results from the equation $\alpha+\beta+\theta=90°$. Naturally it is also possible to change the exit angle θ, which immediately has a marked effect on the X-ray beam yield (see FIG. 4). The angle of incidence α then results depending on the anode angle β at which the X-ray beam 7 is considered.

With a liquid-metal anode X-ray tube which has a represented anode module 1 according to the invention, an increased emission of high-energy photons and a high direct current power consumption with a simultaneously small region of focus 2 is obtained. Such a liquid-metal anode X-ray tube is used as a constituent of an X-radiator according to the invention with an electron source for the emission of electrons, wherein the desired X-ray beams 7 are produced when the electrons strike. This is very helpful in customs and security applications including CT-supported luggage inspection. It can also be used very effectively in the nondestructive analysis of materials or the examination of castings, for example concerning wheel rim weld seams.

| List of reference numbers | |
|---|---|
| 1 | Anode module |
| 2 | Region of focus |
| 3 | Electron entry window |
| 4 | X-ray beam exit window |
| 5 | Direction of incidence |
| 6 | Electron beam |
| 7 | X-ray beam |
| 8 | Constricting channel |
| 9 | Direction of flow |
| 10 | Liquid metal |
| 11 | Line |
| 12 | Exit direction |
| B | Width of the X-ray beam |
| H | Height of the X-ray beam |
| α | Angle of incidence of the electron beam |
| β | Anode angle |
| θ | Exit angle of the X-radiation |

What is claimed is:

1. An anode module for a liquid metal anode x-ray source the anode module comprising:

an electron entry window on the anode module in a region of focus; and an x-ray beam exit window on a portion of the anode module opposite the electron entry window, wherein an exit angle (Θ) between an electron beam that enters the electron entry window along a direction of incidence and an x-ray beam that exits the x-ray beam exit window is between 5° and 50°.

2. An anode module according to claim 1, wherein the electron entry window is one of a metal foil, a diamond film, a ceramic material or a monocrystal from 5 μm to 30 μm thick.

3. An anode module according to claim 2, wherein the metal foil comprises tungsten.

4. An anode module according to claim l, wherein the x-ray beam exit window is a steel sheet from 100 μm to 400 μm thick.

5. An anode module according to claim 1, wherein in the region of focus the anode module is from 100 μm to 350 μm thick in a direction of the incident electron beam.

6. An anode module according to claim 1, wherein in the region of focus the anode module has a constricting channel in a direction of the incident electron beam, and wherein outside the region of focus, the anode module is from 5 mm to 10 mm thick.

7. An anode module according to claim 1, wherein the electron entry window is convexly curved perpendicular to a direction of flow of the liquid metal.

8. An anode module according to claim 1, wherein the x-ray beam exit window is concavely curved perpendicular to a direction of flow of the liquid metal.

9. An anode module according to claim 1, wherein the focus length is 2 mm to 8 mm.

10. An anode module according to claim 1, wherein the effective focus size is 1 mm×1.3 mm.

11. An anode module according claim 1, wherein an axis of the region of focus stands perpendicular to a direction of flow of the liquid metal.

12. An anode module according to claim 1, wherein an angle of incidence (α) is between 5° and 65°.

13. An anode module according to claim 1, wherein an anode angle (β) is between 10° and 50°.

14. An anode module according to claim 1, wherein the angle of incidence (α), the anode angle (β) and the exit angle (Θ) all lie in a single plane.

15. An anode module for a liquid metal anode x-ray source, the anode module comprising:

an electron entry window formed on the anode module in a region of focus, wherein the electron entry window is convexly curved perpendicular to a direction of flow of the liquid metal.

* * * * *